US005367311A

United States Patent [19]

Egashira et al.

[11] Patent Number: 5,367,311

[45] Date of Patent: Nov. 22, 1994

[54] ANTENNA FOR BROAD-BAND ULTRAHIGH FREQUENCY

[75] Inventors: Yoshimi Egashira; Hai Xu, both of Tokyo, Japan

[73] Assignee: Harada Kogyo Kabushiki Kaisha, Tokyo, Japan

[21] Appl. No.: 973,289

[22] Filed: Nov. 9, 1992

[30] Foreign Application Priority Data

Nov. 8, 1991 [JP] Japan ..... 3-292958

[51] Int. Cl.[5] ..... H01Q 9/30

[52] U.S. Cl. ..... 343/749; 343/702; 343/846

[58] Field of Search ..... 343/702, 749, 715, 900, 343/901, 848, 846; H01Q 1/24, 9/00

[56] References Cited

U.S. PATENT DOCUMENTS 4,571,595 2/1986 Phillips et al. ..... 343/749
4,931,806 6/1990 Wunderlich ..... 343/715
5,184,143 2/1993 Marko ..... 343/749

*Primary Examiner*—Donald Hajec
*Assistant Examiner*—Tan Ho
*Attorney, Agent, or Firm*—Koda and Androlia

[57] ABSTRACT

The antenna of the present invention includes an ultra-short antenna element which has an electrical length of lambda/2, a transmission path one end of which is connected to the base of the antenna element, a ground plane obtained from a sheet-form conductive member with an electrical length of lambda/4 which is bent into a U-shape so that first and second portions face each other with the first portion being installed parallel to the transmission path in close proximity to the transmission path so as to create a capacitive coupling with the transmission path, a capacitive coupling member installed at one end of the first portion so that a capacitive coupling is formed between the capacitive coupling member and ground and a coaxial cable with its central conductor connected to an other end of the transmission path and its outer conductor connected to one end of the second portion of the ground plane.

2 Claims, 6 Drawing Sheets

| | | | | | |
|---|---|---|---|---|---|
| MARKER | M1 | (810 MHz) | : | 48.715 Ω | , 7.0254 Ω |
| MARKER | M2 | (880 MHz) | : | 45.008 Ω | , -2.9199 Ω |
| MARKER | M3 | (960 MHz) | : | 63.965 Ω | , 14.463 Ω |
| MARKER | M4 | (1015 MHz) | : | 51.482 Ω | , 1.1133 Ω |

ANTENNA FOR BROAD-BAND ULTRAHIGH FREQUENCY

BACKGROUND OF THE INVENTION

1. Field of the Invention

The present invention relates to an antenna for broad-band ultrahigh frequency or to broad-band ultrashort wave antenna which can be used as, for example, a hand-carried wireless telephone antenna, an automobile wireless telephone antenna, etc. and more particularly to an improvement in a frequency band broadening means for the antennas.

2. Prior Art

It is generally necessary that ultrashort-wave antennas used in wireless telephones of the types described above are compact and light-weight and also that the antennas have broad-band characteristics. However, as the size of the antenna is reduced, the width of the frequency band for the antennas generally becomes narrower. Currently, however, research and development work that is aimed at digitalization of wireless telephone systems has progressed greatly. As a result, the usable frequency band has been expanded from the conventional band width of 860–940 MHz (80 MHz) to a new band width of 810–960 MHz (150 MHz).

One way to improve the broad-band characteristics of the antennas is TO set first and second conductive substrates to face each other in a parallel arrangement, thus forming a $\frac{1}{4}$-wavelength resonator and install a $\frac{1}{2}$-wavelength antenna element on the first conductive substrate. With this structure, a double-tuned circuit is formed by the parallel resonance circuit of the $\frac{1}{4}$-wavelength resonator, and the broad-band antenna characteristics are thus obtained. Antennas obtained pursuant to this method show broad-band characteristics that are considerably improved over those of previous antennas.

Conventional wireless telephone type ultrashort-wave antennas AS described above, however, HAVE problems. The electrical length of the second conductive substrate is about a $\frac{1}{4}$ wave-length; accordingly, if the frequency used is 900 MHz, the overall length becomes approximately 80 mm. Furthermore, in order to lower the "Q" value, it is necessary that the width of the second conductive substrate be approximately 20 to 25 mm. It is further necessary that the $\frac{1}{4}$-wavelength resonator be approximately 8 mm in thickness. Accordingly, even if a loading coil is used to reduce these dimensions, the matching part of the second conductive substrate has a length of 45 to 50 mm, a width of 12 to 13 mm and a thickness of 6 to 8 mm. Thus, it is extremely difficult to reduce the size of the antenna and at the same time to obtain the broad-band characteristics in the antenna.

SUMMARY OF THE INVENTION

The object of the present invention is to provide a broad-band ultrashort-wave antenna which has sufficient broad-band characteristics and can at the same time be made extremely compact.

In the present invention, the following means are adopted in order to solve the problems above and to achieve the object.

More specifically, the antenna of the present invention comprises: an ultrashort-wave antenna element having an electrical length of approximately lambda/2 ($\lambda/2$), in which lambda ($\lambda$) is the wavelength at the high range of the frequency band used; a transmission path connected at any arbitrarily selected end part to the base end of the antenna element; a ground plane made of a sheet or plate-form conductive member with an electrical length of lambda/4 with its middle section bent into a U shape so as to have a first part and a second part that face each other, one end of the first part being installed parallel to the transmission path in close proximity to the transmission path so that capacitive coupling between the first part and the transmission path is created; a capacitive coupling member which is installed at one end of the first part of the ground plane so that capacitive coupling is created between the capacitive coupling member and the earthing; and a coaxial cable with its central conductor connected to the other end of the transmission path and its outer conductor connected to one end of the second part of the ground plane.

In addition, with the structure above, the present invention is designed so that the antenna element resonates in the high range of the frequency band used, an LC circuit formed between the first part of the ground plane including the capacitive coupling member and the earthing resonates in the middle range of the frequency band used, and an LC circuit formed between the first and second parts of the ground plane resonates in the low range of the frequency band used, thus being capable of performing a triple-tuning.

It is desirable that dielectrics be interposed between the transmission path and the first part of the ground plane and between the first and second parts of the ground plane.

As a result of adopting the structure described above, the present invention has the following effects:

More specifically, since the present invention realizes and utilizes a so-called "triple-tuned" system, a good and stable VSWR is maintained across the broad band width even though the size of the antenna is reduced. As a result, an ultra-compact antenna with ultra-broad-band characteristics can be realized. Furthermore, with the dielectrics interposed as described above, an effective contraction rate of the antenna can increase, so that reduction of the antenna size becomes much easier. The matching part used in the ultrashort-wave antenna according to the embodiment of the present invention that will be described below is reduced in size to a length of 30 mm, a width of 10 mm and a thickness of approximately 6 mm. The frequency band characteristics that are narrowed by this reduction in size is compensated for by the triple tuning.

In wireless telephones, which have recently become increasingly smaller and lighter, only the antenna-related parts have been excluded from the reduction in size and weight. Accordingly, reduction of the size and weight of such antenna-related parts has been urgently demanded. Under these circumstances, the ultra-compact antenna with ultra-broad-band characteristics that is realized by the present invention should be deemed to be a notable accomplishment.

DETAILED DESCRIPTION OF THE INVENTION

FIGS. 1(*a*) and 1(*b*) are an external perspective view and a partially cross-sectional perspective view of the main parts of a wireless telephone mounted with an ultrashort-wave antenna according to one embodiment of the present invention.

In FIGS. 1(*a*) and 1(*b*), the reference character 1 represents a rod-form ultrashort-wave antenna element, 2 a wireless telephone case, 3 a transmitter-receiver, and 4 a shoulder strap.

The electrical length of the ultrashort-wave antenna element 1 is set at approximately lambda/2 (λ/2) in which lambda (λ) is the wavelength at the high range of the frequency band used. The base end of the ultrashort-wave antenna element 1 is attached to the wireless telephone case 2 via a shaft support 5 in a manner that the antenna element 1 can pivot as indicated by the arrow. Other antenna-related components are installed inside the wireless telephone case 2.

A transmission path 6, that is also used for impedance matching, consists of a strip line. The transmission path 6 can be straight or curved in shape and one end (or a first end) of the transmission path 6 is connected to the base end of the antenna element 1. The transmission path 6 is installed on the surface of a rectangular dielectric 7. On the back surface of the dielectric 7, one end of a first part 8*a* of a ground plane 8 is installed so as to be parallel to the transmission path 6 and in close proximity to another (or second) end of the transmission path 6, that is the right end in the Figure, so that capacitive coupling is created between the first part 8*a* and the transmission path 6. The ground plane 8 is a plate-form conductive member having an electrical length of lambda/4 and bent into a U-shape at the middle section 8*c*; thus the first part 8*a* described above and a second part 8*b* are formed, and they face each other. A capacitive coupling member 9 which is extended in an L shape in order to allow capacitive coupling with the earthing, which is not shown, is installed at one end, the upper side in the Figure, of the first part 8*a* of the ground plane 8. This capacitive coupling member 9 is fastened to a plastic outer box 11 by means of an insulated attachment screw 10. A dielectric 12 which has a rectangular shape like the rectangular dielectric 7 is interposed between the first part 8*a* and the second part 8*b* of the ground plane 8. A coaxial cable which is used as a feeder is indicated by the reference numeral 13. The central conductor 13*a* of the coaxial cable 13 is connected to the other (or the second) end of the transmission path 6, and the outer conductor 13*b* of the coaxial cable 13 is connected to the end of the second part 8*b* of the ground plane 8. The reference character 14 in FIG. 1(*b*) refers to a wireless telephone set shielded by metal.

FIG. 2(*a*) is a diagram which illustrates the electrical circuitry of the antenna shown in FIG. 1, and FIG. 2(*b*) is an equivalent circuit diagram thereof.

In the antenna of the present invention, as shown in the Figures, it is further designed such that an RLC circuit A which consists of a radiating resistance Ra and reactances La and Ca, which make up the antenna element 1, to form a parallel circuit of Ra+La and Ca resonates in the high frequency range fa of the frequency band used, that an LC circuit E formed between the first part 8*a* of the ground plane 8 including the capacitive coupling member 9 and the earthing to form a parallel circuit of Le and Ce resonates in the intermediate frequency range fe in the frequency band used, and that an LC circuit B formed between the first part 8*a* and second part 8*b* of the ground plane 8 to form a parallel circuit of Lb and Cb resonates in the low frequency range fb of the frequency band used. Thus, it is characterized in that the antenna of the present invention is constructed so that triple tuning can be performed.

The reactances Lc and Cc that are present between the transmission path 6 and the first part 8*a* of the ground place 8 are the distribution constants of the transmission path. In short, these reactances form a parallel circuit C of Lc and Cc as shown in FIG. 2(*b*). This parallel circuit C is a capacitive coupling type circuit in which almost all of the current flows on the Cc side.

FIG. 3(*a*) is a graph showing the return loss characteristics of the equivalent circuit shown in FIG. 2(*b*), and FIG. 3(*b*) is a Smith chart for such a circuit.

Here, the following broad-band frequencies will be applied as the respective resonance frequencies fa, fe and fb of the RLC circuit A of the antenna element 1 and the LC circuits E and B:

fa:1000 MHz fe:880 MHz fb:810 MHz

FIGS. 4(*a*) and 4(*b*) show the reactance characteristics and return loss characteristics obtained in a case where the above-listed frequencies are applied. As seen from these Figures, the resonance frequency fc of the LC parallel circuit consisting of the reactances Lc and Cc is outside the frequency band shown in FIGS. 4(*a*) and 4(*b*).

Since a triple-tuned system is thus realized and employed in the embodiment of the present invention, an ultra-broad-band antenna can be obtained. Furthermore, with the dielectrics interposed, a contraction factor operates effectively so that reduction of the antenna size becomes much easier. Thus, the size of the matching part can be greatly reduced compared to conventional antennas as shown below:

| | Present Embodiment | Conventional Example |
|---|---|---|
| "Length" | 30 mm | 45 to 50 mm |
| "Width" | 10 mm | 12 to 13 mm |
| "Thickness" | 6 mm | 6 to 8 mm |

The antenna of the present embodiment is compact and light-weight and has a simple structure. Accordingly, the antenna is advantageous in that it can be manufactured less expensively than conventional antennas.

FIGS. 5(*a*) and 5(*b*) and FIG. 6 show the results of actual measurements performed in the tests using the embodiment. FIG. 5(*a*) shows return loss characteristics that correspond to FIGS. 3(*a*) and 4(*b*). FIG. 5(*b*) is a graph which shows VSWR characteristics. Furthermore, FIG. 6 is a Smith chart that corresponds to FIG. 3(*b*). As is clear from these Figures that show actual measurement results, the antenna of the present invention has a so-called "triple-tuned system".

Generally, radiation characteristics are governed by the size and length of the transmitter-receiver which is installed underneath the antenna; accordingly, such characteristics are not shown in the Figures as measurement results. In the present embodiment, however, the electrical length of the antenna element 1 is set so that the antenna element 1 is tuned in the vicinity of 960 to 1000 MHz that corresponds to the high range of the used frequency band; thus, the antenna can be a nongrounded type of less than lambda/2 even in the low range of the used frequency band as well, and good radiation characteristics can be obtained in the horizontal direction.

The present invention is not limited to the embodiment described above. It goes without saying that various modifications are possible within the spirit of the present invention.

According to the present invention, a so-called "triple-tuned system" is realized and employed. Therefore, even though the antenna is reduced in size, a good and stable VSWR can be maintained across the broad band width. As a result, it is possible that the present invention can provide a broad-band ultrashort-wave antenna which can be made extremely compact while maintaining sufficient broad-band characteristics.

Figure 1A:
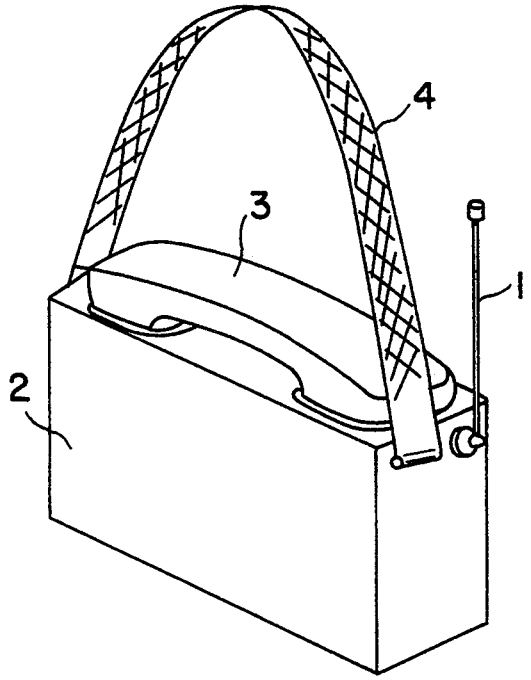
FIGS. 1*a* and 1*b* are an external perspective view and a partially cross-sectional perspective view showing the main parts of a wireless telephone set mounted with an ultrashort-wave antenna according to one embodiment of the present invention.
Figure 1B:
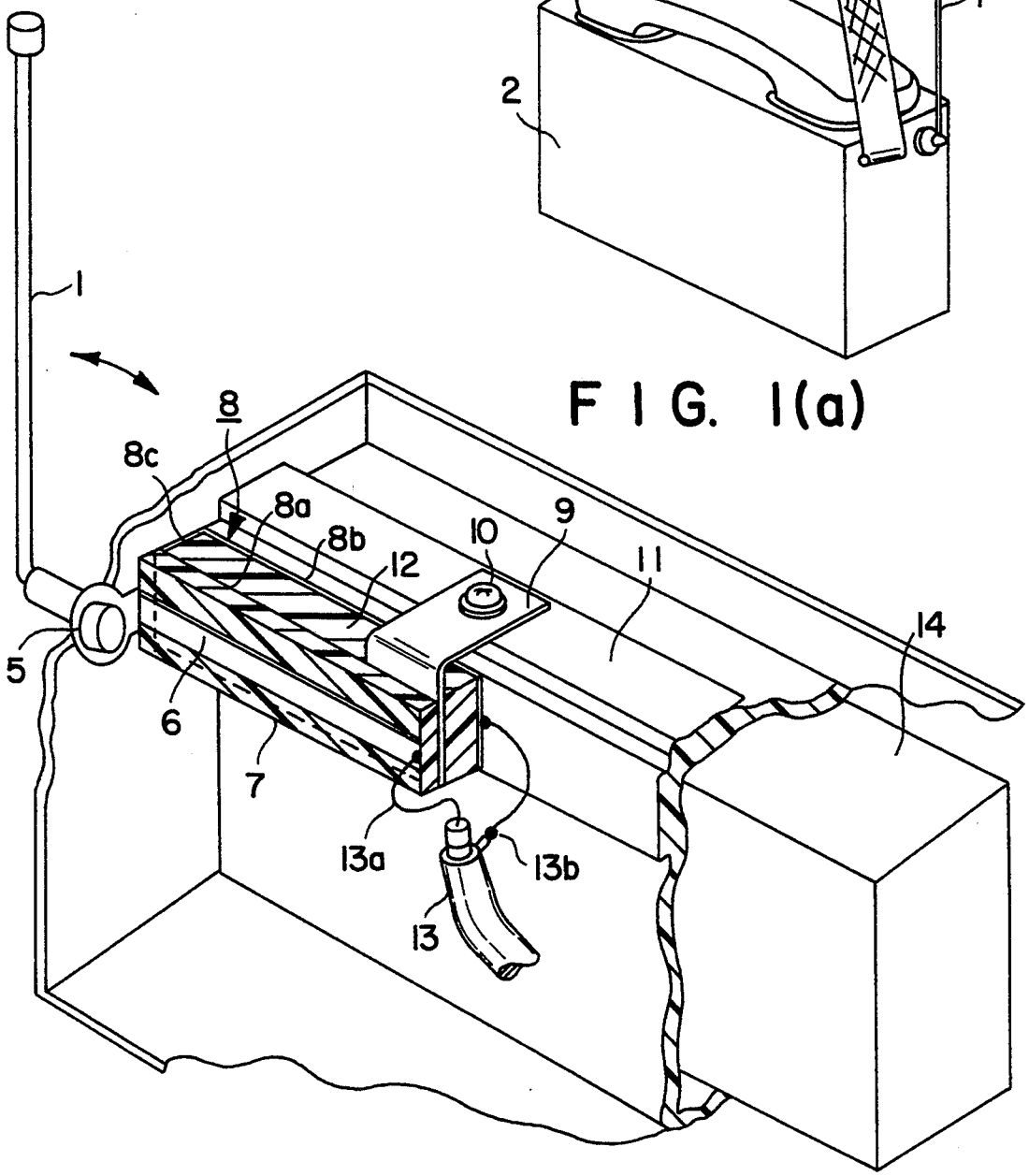
Figure 2A:
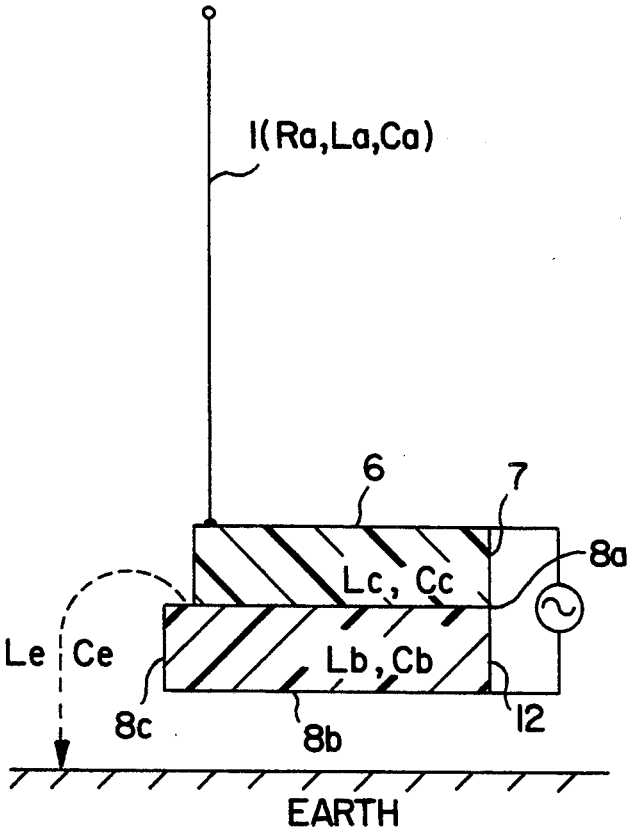
FIGS. 2*a* and 2*b* are an electrical circuitry and an equivalent circuit diagram of the ultrashort-wave antenna of the embodiment.
Figure 2B:
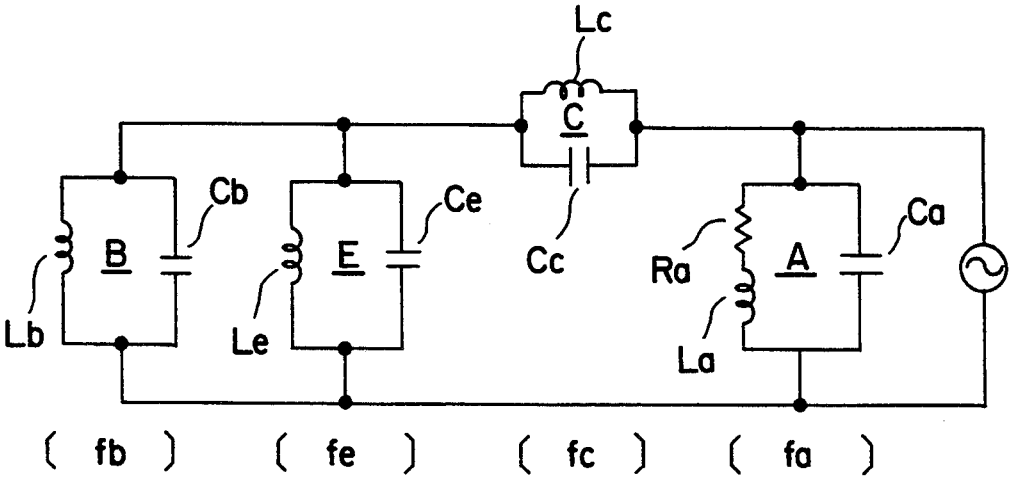
Figure 3A:
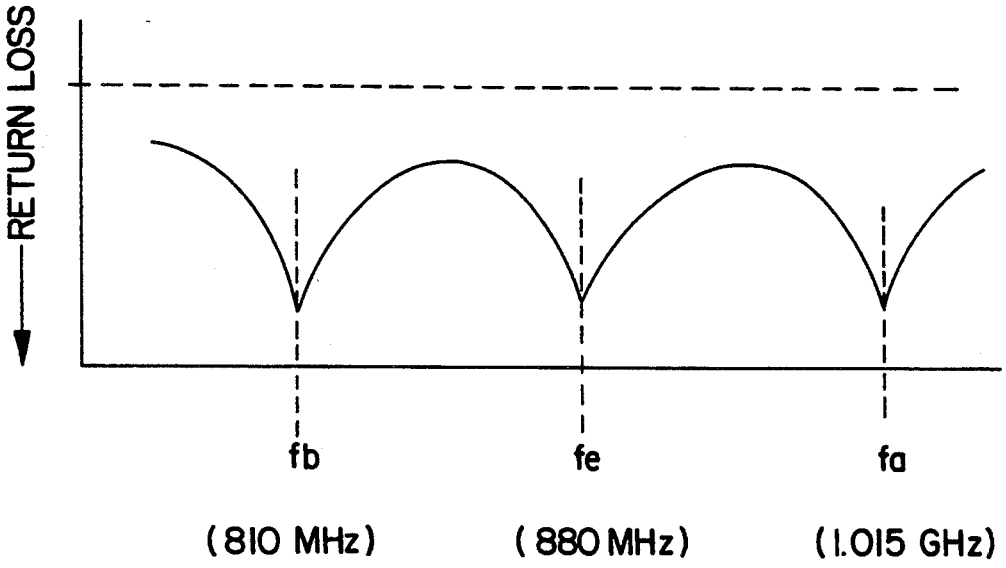
FIGS. 3*a* and 3*b* are of the return loss characteristics and a Smith chart corresponding to the equivalent circuit diagram shown in FIG. 2(*b*).
Figure 3B:
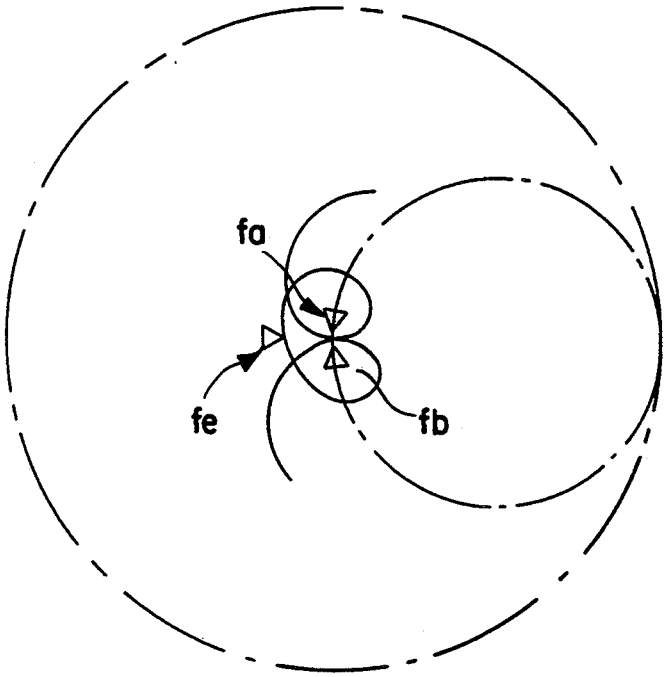
Figure 4A:
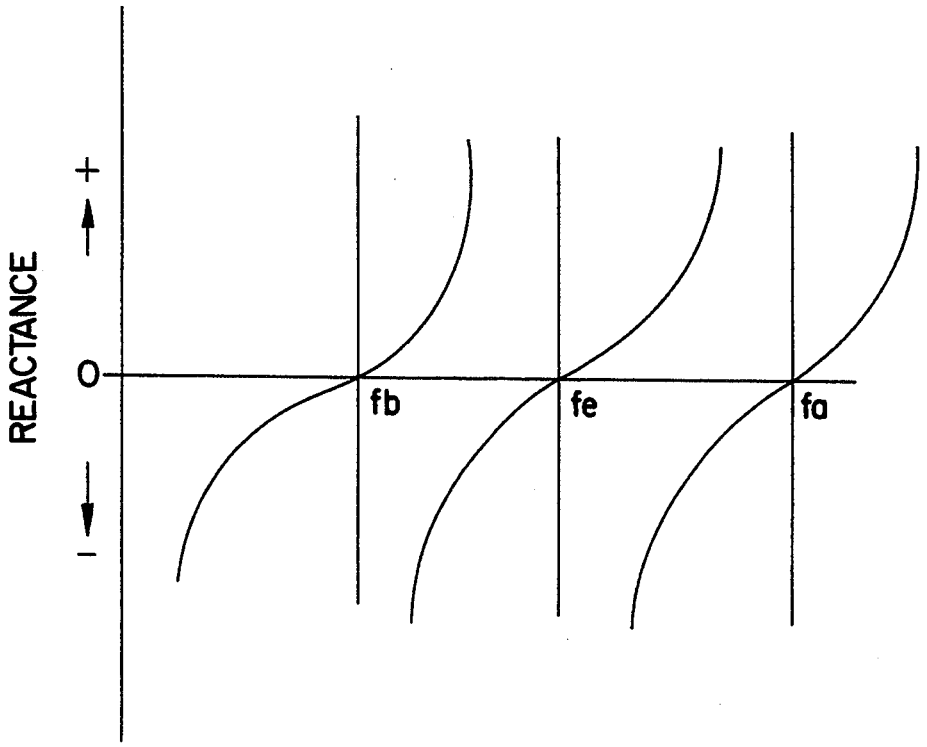
FIGS. 4*a* and 4*b* are grafts of the gain characteristics and the return loss characteristics obtained by the triple-tuned system of the ultrashort-wave antenna of the embodiment.
Figure 4B:
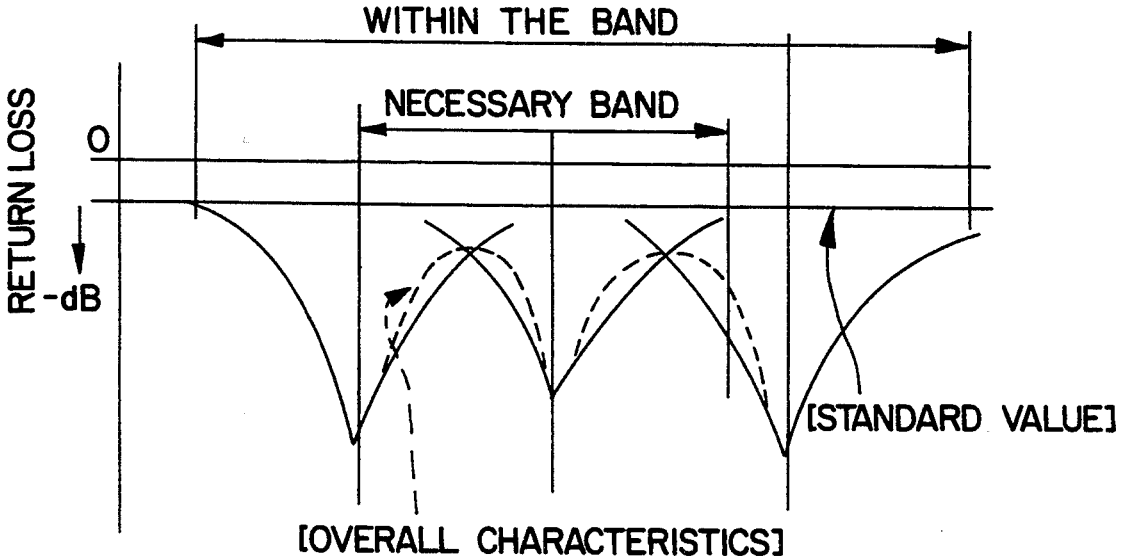
Figure 5A:
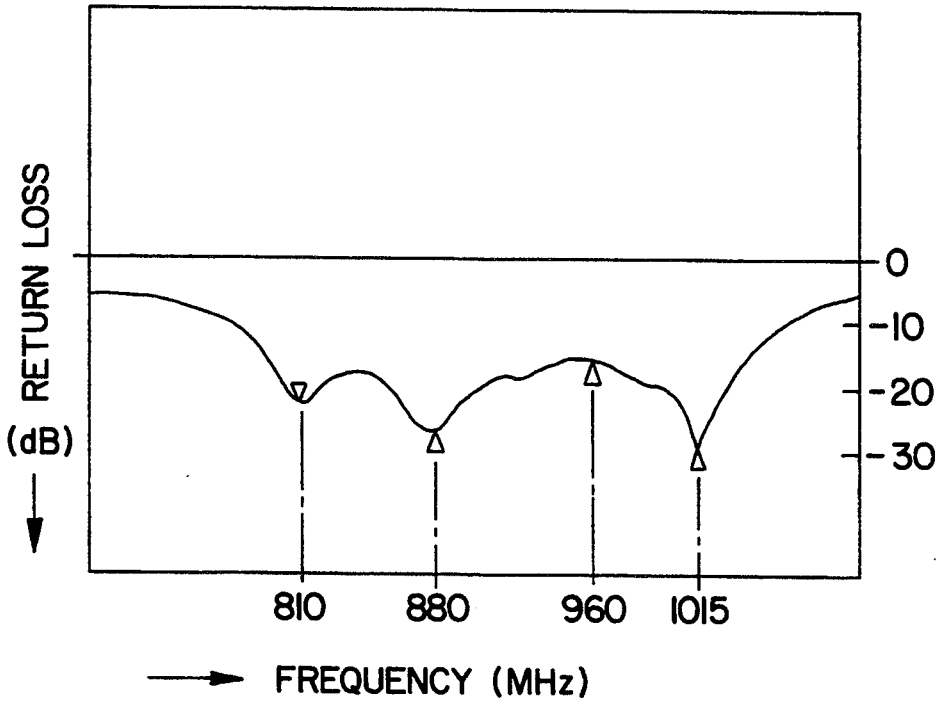
FIG. 5*a* and 5*b* are grafts of the return loss characteristics and the VSWR characteristics measured in the tests performed with the use of the antenna of the embodiment.
Figure 5B:
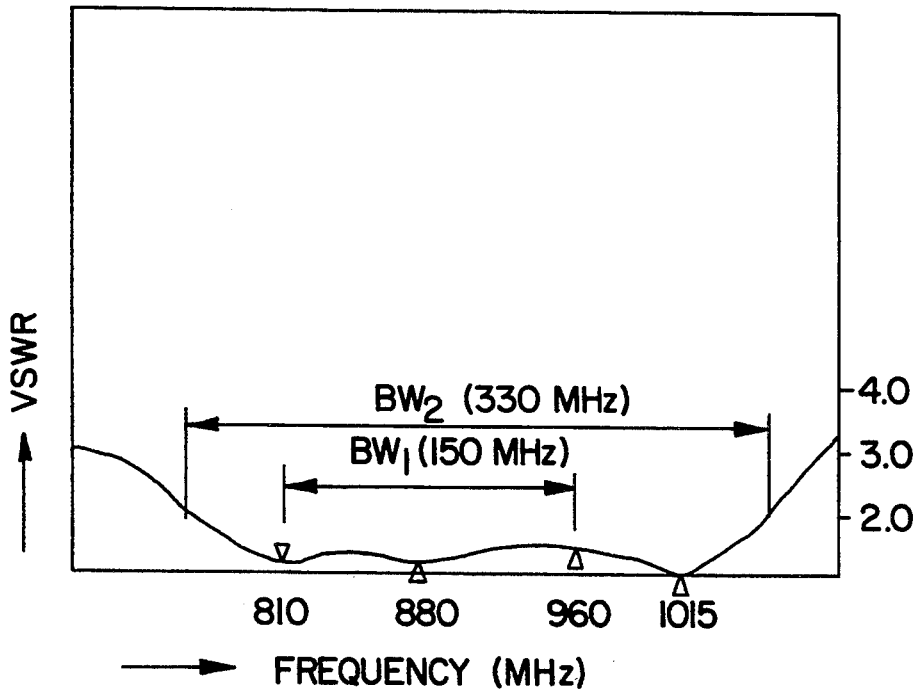
Figure 6:
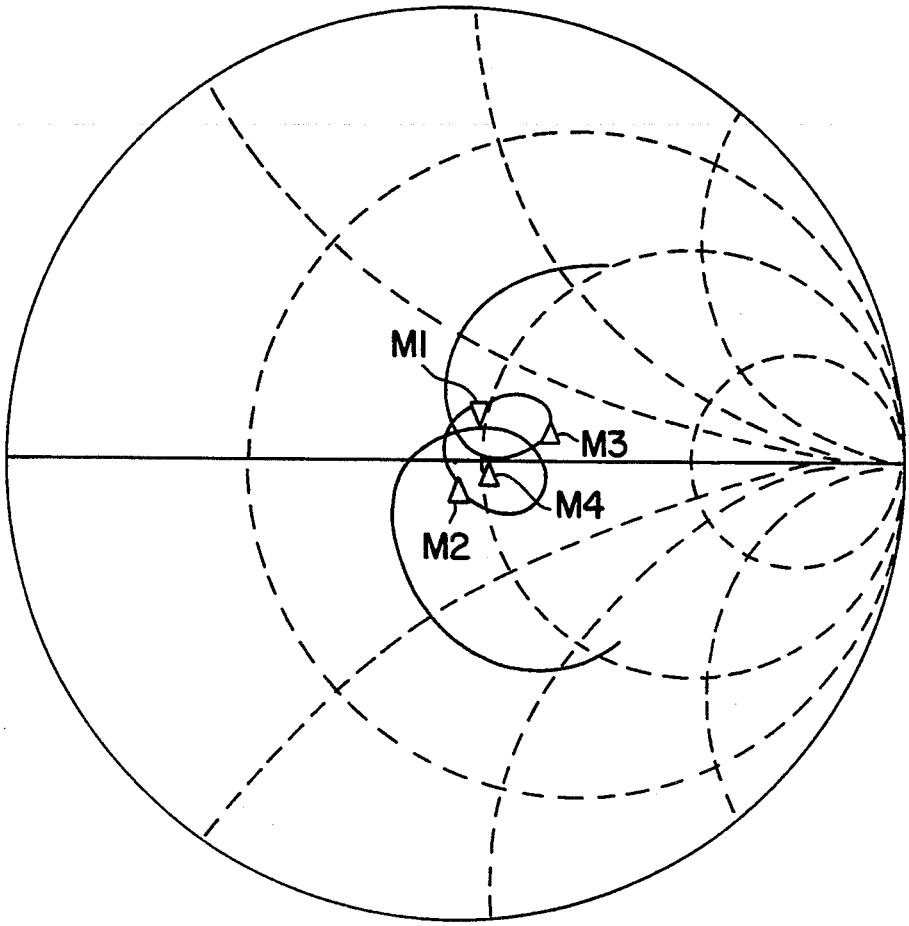
FIG. 6 is a Smith chart measured in the test performed with the use of the embodiment.

What is claimed is:

1. A broad-band ultrashort antenna characterized in that said antenna comprises:

an ultrashort antenna element, the electrical length of said antenna element being substantially lambda/2 in which lambda is a wavelength at a high end of a frequency band used;

a sheet-form transmission path member connected at one end directly to one end of said ultrashort antenna element;

a ground plane made of a sheet-form conductive member that has an electrical length of lambda/4 and is bent at an intermediate portion of said conductive member into a U shape so as to have a first portion and a second portion which face each other, said first portion being installed parallel to said transmission path member in close proximity to said transmission path member so as to be capacitively coupled with said transmission path member;

a capacitive coupling member electrically connected to one end of said first portion of said ground plane so that capacitive coupling is created between said capacitive coupling member and ground; and a coaxial cable with its central conductor connected directly to an other end of said transmission path member and its outer conductor connected to one end of said second portion of said ground plane, and wherein said antenna element resonates in a high end of said frequency band used, an LC circuit formed between said first portion of said ground plane including said capacitive coupling member and said ground resonate in a middle of said frequency band used, and an LC circuit formed between said first and second portions of said ground plane resonates in a low end of said frequency band used whereby a triple-tuned antenna is provided.

2. A broad-band ultrashort antenna according to claim 1 characterized in that a dielectric layer is interposed between said transmission path member and said first portion of said ground plane and a dielectric layer is interposed between said first and second portions of said ground plane.

* * * * *